US005411842A

United States Patent [19]

Ridgway et al.

[11] Patent Number: 5,411,842

[45] Date of Patent: May 2, 1995

[54] METHOD OF MAKING A PHOTOGRAPHIC DEVELOPER SOLUTION

[75] Inventors: Michael Ridgway, Tring; Nigel E. Milner, Watford; Siu C. Tsoi, Watford; Paul C. Ward, Watford, all of England

[73] Assignee: Eastman Kodak Company, Rochester, N.Y.

[21] Appl. No.: 224,368

[22] Filed: Apr. 7, 1994

[30] Foreign Application Priority Data

Apr. 13, 1993 [GB] United Kingdom ..... 9307503

[51] Int. Cl.[6] ..... G03C 7/407

[52] U.S. Cl. ..... 430/443; 430/435; 430/444; 430/467; 430/484

[58] Field of Search ..... 430/415, 419, 420, 433, 430/434, 435, 439, 440, 443, 450, 464, 467, 477, 482, 444, 484

[56] References Cited

U.S. PATENT DOCUMENTS

| | | | |
|---|---|---|---|
| 3,301,772 | 1/1967 | Viro . | |
| 3,362,823 | 1/1968 | Land . | |
| 3,615,515 | 10/1971 | Lasky . | |
| 3,733,993 | 5/1973 | Lasky . | |
| 4,243,745 | 1/1981 | Fry | 430/433 |

FOREIGN PATENT DOCUMENTS

| | | |
|---|---|---|
| 59/142548 | 8/1984 | Japan . |
| 1572334 | 7/1980 | United Kingdom . |
| 2007378 | 3/1982 | United Kingdom . |

*Primary Examiner*—Hoa Van Le

*Attorney, Agent, or Firm*—Sarah Meeks Roberts; J. Lanny Tucker

[57] ABSTRACT

A method for making a photographic silver halide developer composition, preferably immediately before use, by electrolysing an aqueous medium containing a developing agent precursor composition which forms or releases a silver halide developing agent at an electrode upon electrolysis.

9 Claims, 1 Drawing Sheet

METHOD OF MAKING A PHOTOGRAPHIC DEVELOPER SOLUTION

This invention relates to a method of making photographic developer solutions, developer precursor compositions and to a method of silver halide development.

FIELD OF THE INVENTION

The invention relates to the development of imagewise exposed photographic silver halide materials.

BACKGROUND OF THE INVENTION

Silver halide developing agents are reducing agents and their solutions tend to oxidise when in contact with the air. Developer formulations, therefore, usually contain one or more antioxidants or "preservatives" which become oxidised sacrificially in order to avoid oxidation of the developing agent. Examples of such compounds are alkali metal sulphites which are contained in most developers both black and white and colour and hydroxylamine compounds which are often present in colour developers. However, even with such preservatives being present, developer solutions are still oxidised by the air in a period of weeks. It is sometimes necessary to discard a developer solution not because it is exhausted by use but because it has oxidised in the air.

PROBLEM TO BE SOLVED BY THE INVENTION

Especially for situations where use of a photographic developer is spasmodic or intermittent, it would be desirable to be able to use a developer solution which did not oxidise in the air or to make the developer immediately before it is used.

SUMMARY OF THE INVENTION

The present invention provides method for making a photographic silver halide developer composition, preferably immediately before use, by electrolysing an aqueous medium containing a developing agent precursor composition which forms or releases a silver halide developing agent at an electrode upon electrolysis.

ADVANTAGEOUS EFFECT OF THE INVENTION

The developing agent precursor composition is stable to aerial oxidation.

Colour office copiers which operate by employing a silver halide colour material will need less attention because the "developer" solution will effectively be much more stable.

Colour processing machines which are used on demand and rarely operate continuously would also be able to benefit from a "developer" solution that is very stable. This would apply to both minilab processors and to colour print making machines designed for users who like to enlarge and crop their own pictures and for machines designed to make prints from Photo CD discs.

The present method of producing developer solution on demand would be very efficient in "one shot" chemistry where a developer solution would be used once and then discarded. The exact amount of developer made on each occasion could be related to the amount of development that will be required. That is, a more heavily exposed negative material would require relatively more developer than a lightly exposed one. Methods are known for applying minimal amounts of "one shot" chemistry include application by spraying, surface coating and the like. Such a system would minimise the use of developer and thus minimise the effluent.

Because the developer solution in use would not contain many of the usual constituents of normal developer solutions, the effluent would contain less chemicals and would be easier to process.

An additional advantage is that the developer solution produced in the present invention may be entirely free of the usual developer solution preservatives as the solution is used immediately and does not have to be stable to aerial oxidation. Thus a colour developer would not need to contain N,N-diethylhydroxylamine, a commonly used additive.

BRIEF DESCRIPTION OF THE DRAWINGS

The FIGS. 1 and 2 in the accompanying drawings show a cross-section of a cell for electrolysing a solution to provide a developer solution when required.

DETAILED DESCRIPTION OF THE INVENTION

Figure 1:
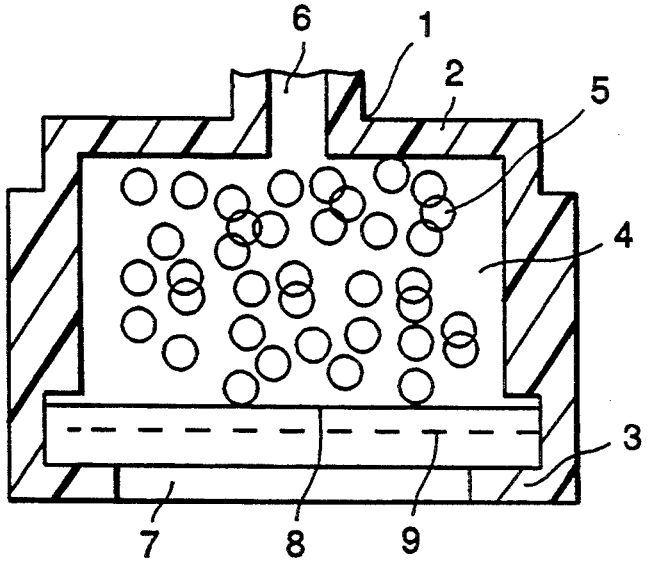

As precursors for a primary amino colour developers there may be used appropriate nitroso, nitro or azo compounds which are converted to primary amino compounds upon electrolysis while a colour developing agent blocked by, for example, a 2,2,2-trichloroethoxycarbonyl group can be likewise unblocked.

In one embodiment of the present invention the developer precursor may have the general formula:

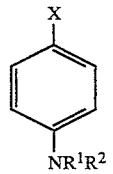

(1)

wherein

X is a $—NO_2$, —NO, or $—N{=}N—R^3$ group, $R^1$ and $R^2$ represent individually one or more hydrogen atoms or an alkyl, aryl or heterocyclic group any of which may be substituted, at least one of $R^1$ and $R^2$ not being hydrogen, $R^3$ is an alkyl, aryl or heterocyclic group any of which may be substituted, and wherein the benzene ring may be further substituted.

In another embodiment of the present invention the developer precursor may have the general formula:

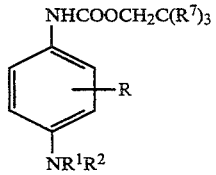

(2)

where $R^1$, $R^2$ and R are as defined above, and each R7 is individually H or halogen provided that not more than one of them is H.

In a further embodiment of the present invention the developer precursor may have the general formula:

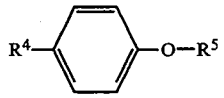

(3)

wherein $R^4$ is —OH or —NH—$R^6$, $R^6$ is an alkyl group of 1–4 carbon atoms, and $R^5$ is —$COOCH_2C(R^7)_3$ or 2- or 4-piccolyl where each R7 is individually H or halogen provided that nor more than one of them is H.

Examples of alkyl, aryl or heterocyclic groups that R, $R^1$, $R^2$ may represent are straight chain or branched alkyl groups of 1 to 22 carbon atoms, phenyl, naphthyl, pyridyl, piperidyl, thiazolyl, or thienyl groups any of which my be substituted by a halogen atom (e.g. a fluorine, chlorine or bromine atom), an alkyl group (e.g., a methyl, t-octyl, group, or trifluoromethyl group), an alkenyl group (e.g., an allyl, octadecenyl), an aryl group (e.g., a phenyl, p-tolyl or naphthyl group), an alkoxy group (e.g., a methoxy, benzyloxy or methoxyethoxy group), an aryloxy group (e.g., a phenoxy, 2,4-di-tert-amylphenoxy or 3-tert-butyl-4-hydroxyphenoxy group), an acyl group (e.g., an acetyl or benzoyl group), a sulfonyl group (e.g., a methanesulfonyl or toluenesulfonyl group), a carboxy group, a sulfo group, a cyano group, a hydroxy group, an amino group (e.g., a primary, secondary or tertiary amino group, eg a dimethylamino), a carbonamido group (e.g., an acetamido, trifluoroacetamido, tetradecanamido, or a benzamido group), a sulfonamido group (e.g., a methanesulfonamido, hexadecanesulfonamido, or p-toluenesulfonamido group), an acyloxy group (e.g., an acetoxy group), a sulfonyloxy group (e.g., a methanesulfonyloxy group), an alkoxycarbonyl group (e.g., a dodecyloxycarbonyl group), an aryloxycarbonyl group (e.g., phenoxycarbonyl group), a carbamoyl group (e.g., a dimethylcarbamoyl group), a sulfamoyl group (e.g., a methylsulfamoyl or hexadecylsulfamoyl group), an imido group (e.g., a succinimido, phthalimido or an octadecenylsuccinimido group), a heterocyclic group (e.g., a 2-pyridyl, 2-furyl or a 2-thienyl group), an alkylthio group (e.g., a methylthio group), and an arylthio group (e.g., a phenylthio group).

Any of the above substituents may also be present on the benzene ring of formula (1). Examples of groups $R^7$ are H, Cl and F. Examples of groups $R^5$ are —$COOCH_2CHCl_2$ and —$COOCH_2CCl_3$.

Examples of precursors of the above types are: N-ethyl-N-(2-hydroxymethyl)-4-nitroaniline, N-ethyl-3-methyl-N-(2-methylsulphonamidoethyl)-4-nitrosoaniline, N,N-dimethyl-4-nitrosoaniline, an N,N-dialkyl-p-azo-substituted aniline and N,N-diethyl-p-phenylenediamine blocked on the primary amino group with a 2,2,2-trichloroethoxycarbonyl group.

In a first form of the present invention the developer precursor composition is in the form of an aqueous solution containing an ionic salt which is electrolysed and applied to the photographic material to be processed. The presence of the ionic salt makes the solution more conductive. Examples of such salts are sodium or potassium nitrite, nitrate, acetate, formate. The salt may with advantage also act as a buffer; for example it may be sodium or potassium carbonate/bicarbonate.

In a second form of the present invention the developing agent precursor composition is incorporated into a layer of the photographic material to be processed. Such a layer could be a silver halide or coupler containing layer, an interlayer, underlayer or overlayer. It is preferred that the developing agent precursor is water-soluble but a water-insoluble precursor could be used if a water-soluble electron transfer agent were present. Preferably in this embodiment additional water is added to ensure that electrolysis and subsequent development takes place. This is preferably an alkaline solution. The developing agent precursor is preferably colourless. If the precursor is not colourless it is preferably incorporated in the bottom layer (nearest the support) of the photographic material.

In the second form of the invention using a colourless water-insoluble developing agent precursor, it is possible to partially reduce the precursor to developing agent in areas of low exposure thus reducing the loss of unused developer to the environment.

In the second form of the invention there may be used a stainless steel drum that processes the photographic material using a simple carbonate activator, generating developer when in contact with the paper and destroying or removing unused developer when the paper is removed. This could be achieved by allowing the drum to come in contact with a "developer sink" such as a mild oxidising solution, a third electrode at a lower potential or a suitable resin which would remove developing agent from the photographic material.

In one embodiment of the present invention the developer precursor composition also contains a perborate, eg sodium perborate. After electrolysis a colour developer plus a peroxide is provided which is capable of redox amplification, i.e. it produces a higher density that a solution without perborate. This is not the case if hydrogen peroxide is used in place of the perborate.

In a particular embodiment of the present invention the cell shown in cross-section in FIG. 1 is used to perform the electrolysis. The cell (1) comprises two cooperating elements (2) and (3) which are assembled by screwing them together to form a cell body (4) filled with fibrous electrically conductive material (5), for example, steel or stainless steel "wool", an inlet (6) and outlet (7). Placed into (3) before assembly with (4) are the conductive "wool" (9), and a filter element (8), eg of paper or sintered glass. To operate the cell the anode is connected to the mesh (9) while the cathode is connected to the steel wool (5). The cell is submerged in a solution of the developer precursor and liquid is drawn up and out of outlet (7). At the same time a voltage, eg of 2–3 volts, is applied. The emerging liquid is the active developer solution. The exact conditions of flow rate and voltage for a particular application are to be determined by experiment. Normally the initial flow should be discarded until constant conditions are being maintained. This usually happens very quickly. After use the cell could be removed from the developer precursor composition and flushed through with water. Alternatively any developing agent left in the cell could migrate to the filter element (8) where it would be oxidised either aerially or by the anode.

Figure 2:
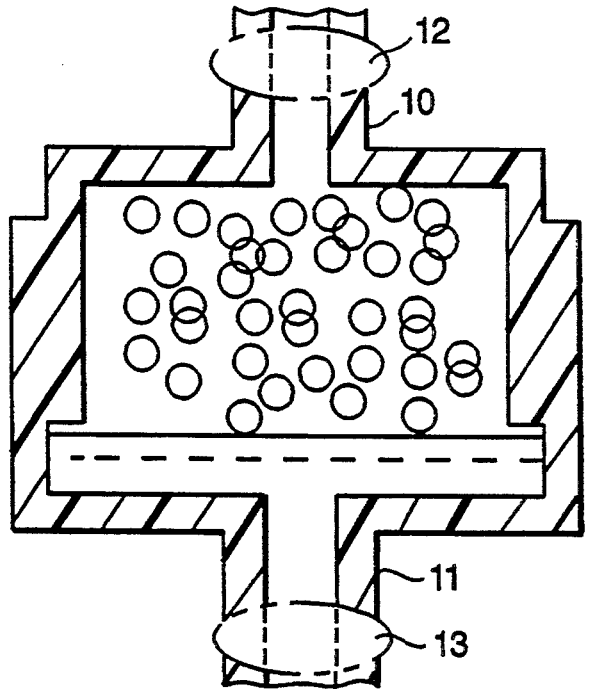

In FIG. 2 a device similar to that shown is FIG. 1 is shown having reshaped inlet (10) and outlet (11) fitted with valves (12) and (13) so that the unit can be isolated from atmospheric oxygen by closing the valves when the device is not in use.

An alternative form of apparatus comprises a metal mesh cathode, e.g. of stainless steel, in contact with the photographic material's surface. In such an arrangement the developer is formed actually in contact with the photographic material to be processed. Alternatively a steel dish (anode) lined with filter paper to provide separation from a stainless steel mesh cathode is used. In some embodiments agitation should be minimal to avoid removal of the nitroso intermediate compound from the vicinity of the cathode.

The invention may also be applied to black and white developers. For example p-nitrophenol may be converted to p-aminophenol by electrolysis. In addition, azo compounds may also be used, in particular the following compounds:

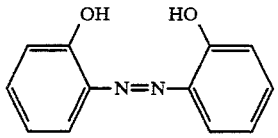

(4)

and

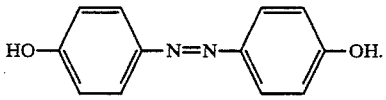

(5)

Hydrazine compounds may also be used, for example the compound of the formula:

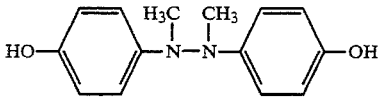

(6)

Further useful compounds have the general formula:

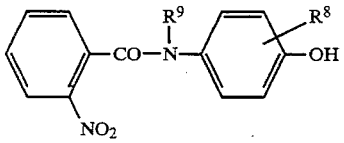

(7)

or

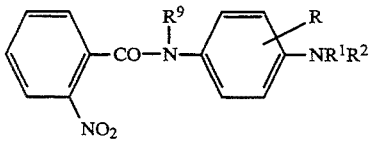

(8)

wherein

R, $R^1$ and $R^2$ are as defined above, $R^8$ is H or a water-solubilising group, $R^9$ is H or a 1-4C alkyl group, and wherein the left hand benzene ring may be further substituted, which will release a developing agent in the presence of sulphinic acid whereby the nitrophenylcarbonyl group is eliminated.

The developer precursor will normally be contained in a buffered solution prior to electrolysis, for example a solution buffered to a pH value of from 10–12, preferably from 10.5 to 11.5. The solution need not contain any other constituents in order to form a fully acceptable developer solution after electrolysis.

The electrolysis preferably takes place at a voltage below which water itself is hydrolysed. A voltage of 1–3 volts and a time period which can typically vary from 10 sec to 10 minutes is preferred.

The following Examples are included for a better understanding of the invention.

EXAMPLE 1

In this example the following materials were used:

Compound 1=N-Ethyl-N-(2-hydroxyethyl)-4-nitroaniline

Compound 2=N-Ethyl-3-methyl-N-(2-methylsulphonamidoethyl)-4-nitrosoaniline) (Nitroso precursor of CD3)

Compound 3=Methyl orange. (An N,N-dialkyl-p-azosubstituted aniline)

Compound 4=N-N-Diethyl-p-phenylenediamine, blocked on the unsubstituted nitrogen with 2,2,2-Trichloroethoxycarbonyl Buffer=4 gm sodium hydrogen carbonate+4 gm sodium carbonate dissolved in 100 cc water.

Precursor solution No. 1

0.25 grm of compound 1 was dissolved in 25 cc EtOH and 100 cc Buffer was added.

Precursor solution No. 2

0.2 grm compound was dissolved in 20 cc EtOH. (Slow to dissolve, warm). 200 cc of buffer was added and stirred. Some compound 2 precipitated out on keeping.

Precursor solution No. 3

50 mg of compound 3 were stirred in 100 cc of buffer and warmed for 5 minutes. After this time the solution was allowed to settle and the clear supernatant liquor used as the test liquid. Precursor solution No. 4 0.1 grm of compound 4 were dissolved in 30 cc ethanol and 25 cc water and 10 cc buffer were added in that order.

A cell was made up as shown in FIG. 1 in which inlet (6) was a 5 cm diameter circle of stainless steel mesh separated from a half inch thick pad of steel wool by a filter paper. The cell was placed in a beaker of each of the above precursor solutions and an electrical supply of 2–3 volts placed across the electrodes with the inlet positive with respect to the steel wool. The cell was started by electrolysing for a few minutes and then withdrawing and discarding a few cc of liquid. After that the electrical supply was turned off except where withdrawing developer. Almost colourless developer could be drawn from the cell over a long period of time. The developer left in the cell after withdrawing the required quantity could migrate through the filter paper to the anode, where it could be oxidised either aerially or by the anode. Any developer oxidised in this way gave the usual brown/black oxidation products which were removed by the filter paper and/or the steel wool.

Other demonstrations of the action can be made using a variety of arrangements of electrodes. Among the more interesting are stainless steel mesh cathodes with the photographic product emulsion side to the cathode, (giving very fast results with the minimum of solutions) and steel dishes lined with filter paper to give separation from a stainless steel mesh cathode. Note, in some arrangements agitation must be minimal with precursor No. 1 to get quick results. This precursor may possibly reduce via the nitroso form.

EXAMPLE 2

25 cc of precursor solution No. 2 mixed with 2 cc of freshly prepared 1% sodium perborate solution were put in a flat steel dish, which was used as the anode. A filter paper was used to line the dish and a stainless steel mesh placed on top and used as cathode. The mixture was electrolysed immediately as in Example 1 with stirring and quickly gave a developer that showed image amplification with a low silver coating, demonstrating that the reduction can take place in the presence of perborate ion. (See patent British Specification No. 1268126, 17 Apr., 1992, on redox amplification chemistry).

EXAMPLE 3

A colour developing agent precursor N-ethyl-3-methyl-N-(2-methylsulphonamidoethyl)-4-nitrosoaniline)(precursor of CD3) (0.1 g) was dissolved in tetrahydrofuran (5 ml), after which an equal volume of water and then 20% gelatin solution (10 ml)were added at 40° C. A strip of conventional colour paper was dipped into the solution, withdrawn, and the liquid allowed to set.

The light-exposed coated material is processed using a stainless steel dish (anode) liner with filter paper (porous insulator) having a stainless steel mesh on top (cathode). The dish is moistened with a little 4% carbonate/bicarbonate solution (pH=9.8). The paper sample is placed emulsion side down on the stainless steel mesh and electrolysed at 2 V for two minutes during which time development takes place. A control with no precursor showed no development.

We claim:

1. A method for making a photographic silver halide color developer composition comprising electrolysing an aqueous medium containing a silver halide color developing agent precursor composition which forms or releases a silver halide developing agent at an electrode upon electrolysis, wherein the silver halide color developing agent precursor has either the general formula (1):

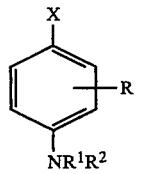

wherein

X is a $—NO_2$, —NO, or $—N{=}N—R^3$ group,

R represents individually one or more hydrogen or halogen atoms or an alkyl, aryl or heterocyclic group any of which may be substituted, $R^1$ and $R^2$ represent individually one or more hydrogen atoms or an alkyl, aryl or heterocyclic group any of which may be substituted, at least one of $R^1$ and $R^2$ not being hydrogen, $R^3$ is an alkyl, aryl or heterocyclic group any of which may be substituted, and wherein the benzene ring may be further substituted, or the general formula (2):.

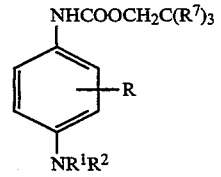

wherein $R^1$, $R^2$ and R are as defined above, and each $R^7$ is individually H or halogen provided that not more than one of them is H.

2. The method of claim 1 in which the silver halide color developing agent precursor is: N-ethyl-N-(2-hydroxymethyl)-4-nitroaniline, N-ethyl-3-methyl-N-(2-methylsulphonamidoethyl)-4-nitrosoaniline, N,N-dimethyl-4-nitrosoaniline, an N,N-dialkyl-p-azo-substituted aniline or a N,N-diethyl-p-phenylenediamine blocked on the primary amino group with a 2,2,2-trichloroethoxycarbonyl group.

3. The method of claim 1 in which the silver halide color developer precursor composition is in the form of an aqueous solution containing an ionic salt which is electrolysed and applied to the photographic material to be processed.

4. The method of claim 1 in which the silver halide color developing agent precursor composition is incorporated into a layer of the photographic material to be processed.

5. The method of claim 1 wherein said silver halide color developing agent precursor composition contains no antioxidant constituents.

6. The method of claim 1 wherein said silver halide color developing agent precursor composition further contains perborate or percarbonate ions.

7. The method of claim 5 wherein said silver halide color developing agent precursor composition further contains no other constituents.

8. The method of claim 6 wherein said silver halide color developing agent precursor composition further contains no other constituents.

9. The method of claim 1 wherein said electrolysing step is carried out immediately before use of said provided photographic silver halide color developer composition.

* * * * *